US005826461A

United States Patent [19]

Kaywood et al.

[11] Patent Number: 5,826,461

[45] Date of Patent: Oct. 27, 1998

[54] CAMSHAFT ASSEMBLY AND METHOD OF MAKING THE SAME

[75] Inventors: Roy G. Kaywood, Jackson; John M. Yost, Horton, both of Mich.

[73] Assignee: Kaywood Products Corporation, Jackson, Mich.

[21] Appl. No.: 589,297

[22] Filed: Jan. 22, 1996

[51] Int. Cl.[6] ..... F01L 1/04

[52] U.S. Cl. ..... 74/567; 123/90.6; 403/354

[58] Field of Search ..... 94/567, 595, 572; 123/90.6; 403/354, 373, 258, 260

[56] References Cited

U.S. PATENT DOCUMENTS

| | | | |
|---|---|---|---|
| 2,828,374 | 3/1958 | Redick | 403/354 X |
| 3,062,569 | 11/1962 | Westermeier | 403/354 |
| 4,214,568 | 7/1980 | Ito et al. | 74/567 X |
| 4,597,365 | 7/1986 | Madaffer | 123/90 |
| 4,665,766 | 5/1987 | Umeha et al. | 74/567 |
| 4,835,832 | 6/1989 | Arnold et al. | 123/90 |
| 4,838,217 | 6/1989 | Ruf et al. | 123/90.6 |
| 4,841,627 | 6/1989 | Arnold et al. | 29/720 |
| 5,158,049 | 10/1992 | Neumann | 74/567 X |
| 5,197,351 | 3/1993 | Hishida | 123/90.6 X |
| 5,259,268 | 11/1993 | Ebbinghaus | 123/90.6 X |
| 5,441,021 | 8/1995 | Moore, II | 123/90.6 X |

*Primary Examiner*—Charles A. Marmor
*Assistant Examiner*—Saul J. Rodriquez
*Attorney, Agent, or Firm*—Barnes, Kisselle, Raisch, Choate, Whittemore & Hulbert

[57] ABSTRACT

A cam shaft assembly for an engine has a hollow elongate shaft with a plurality of cam lobes and bearing journals received on and positioned along the shaft in a predetermined spaced apart relationship. The cam lobes are further oriented angularly in a predetermined alignment relative to one another. A radial thrust bearing is received and positioned on one end of the shaft. Each of the elements is secured to the shaft by mechanically expanding the shaft into an interference relationship with an opening in each element. A cam timing gear is fastened to the one end of the shaft by a fastener passing through the gear and into the one end of the shaft. Threads formed on the fastener engage complimentary threads formed on the internal surface of the shaft to allow the cam gear to be torqued down. A recess is formed in the shaft, the cam gear or both for receiving a projection or key which accurately aligns the gear to the cam lobes on the shaft and locks the gear in position.

7 Claims, 1 Drawing Sheet

CAMSHAFT ASSEMBLY AND METHOD OF MAKING THE SAME

FIELD OF THE INVENTION

This invention relates to camshafts, and more particularly to a hollow camshaft assembly for an engine and a method for making the same.

BACKGROUND OF THE INVENTION

A camshaft having bearing journal elements and cam lobe elements assembled on a hollow shaft or tube is known in the art. An example is disclosed in U.S. Pat. No. 4,597,365. A method of assembling this type of camshaft assembly by mechanically expanding the hollow shaft to retain the elements thereon is also known in the art. Examples of the method are disclosed in U.S. Pat. Nos. 4,835,832 and 4,597,365.

A problem with the aforementioned prior art camshaft assembly is that there has been no economical and durable form of attaching the timing sprocket and radial thrust bearing to the shaft. Another problem is that there has been no relatively simple way of accurately orienting the timing sprocket to the cam elements of the shaft. The traditional method utilizes a dowel pin inserted through a hole in the sprocket into a complimentary hole in the radial thrust bearing end surface.

SUMMARY OF THE INVENTION

A camshaft assembly for an engine comprises a hollow elongate shaft or tube having a number of cam lobes and bearing journals each having an opening for being received on and positioned longitudinally along the shaft in a predetermined spaced apart relationship. The cam lobes are further oriented rotationally in a predetermined angular alignment relative to one another. A radial thrust bearing is also received and positioned on one end of the shaft. Each of the aforementioned elements is secured to the shaft by mechanically expanding the shaft into an interference relationship with the opening in each element. A cam timing gear is fastened to the one end of the shaft by a fastener passing through the gear and into the one end of the hollow shaft. Threads formed on the fastener engage complimentary threads formed on the internal surface of the shaft to allow the cam gear to be torqued down. A recess is formed in either the shaft or the cam gear for receiving a complimentary projection or key accurately aligning the gear to the cam lobes on the shaft and locking them in a predetermined rotational or angular orientation.

Objects, features and advantages of the invention are to provide a relatively lightweight camshaft assembly that has a hollow shaft and a cam gear or sprocket accurately rotationally or angularly oriented with respect to the cam lobe elements assembled to the shaft, allows flexibility in the manufacture of the front bearing journal, reduces the total cost of the thrust portion of the camshaft, reduces the number of parts, allows for centerless grinding of the radial thrust bearing and sprocket mounting diameters, allows for flexibility in the material selection of the sprocket, permits assembly of the sprocket to the shaft without interference with the radial thrust half of the bearing, and is rugged, durable, reliable, of relatively simple design and economical manufacture and assembly.

DETAILED DESCRIPTION OF THE PREFERRED EMBODIMENTS

Figure 1:
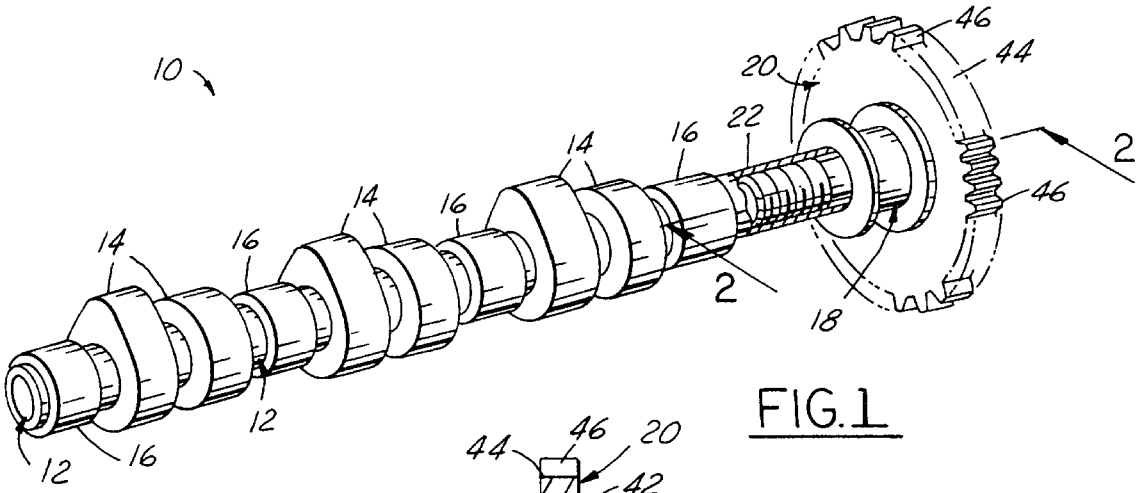
FIG. 1 is a perspective view of a camshaft assembly according to this invention showing a partial fragmentary sectional view of the radial thrust portion.
Figure 2:
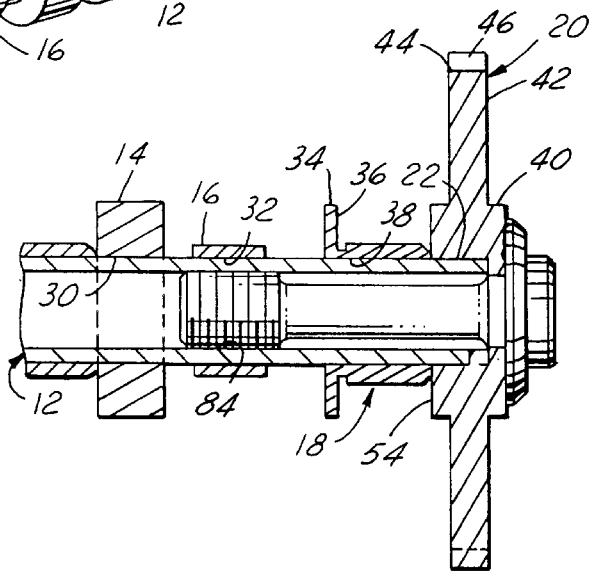
FIG. 2 is a sectional view of the radial thrust portion of the camshaft assembly shown in FIG. 1 taken along line 2–2.
Figure 5:
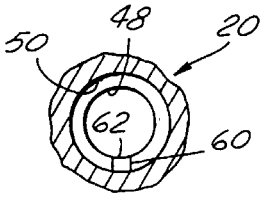
FIG. 5 is a cross-sectional view of a portion of the cam gear taken along line 5–5 as shown in FIG. 3.
Figure 3:
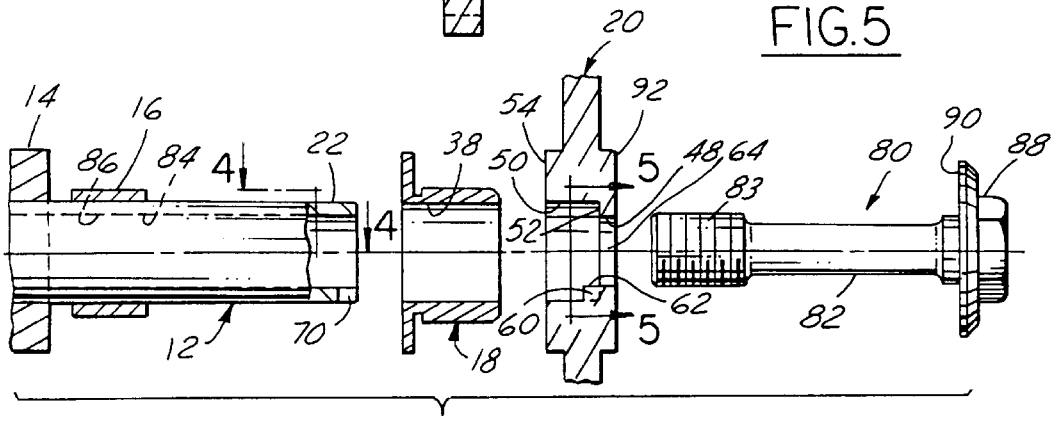
FIG. 3 is an exploded view of the components prior to assembly of the radial thrust portion of the camshaft assembly of FIG. 1.
Figure 4:
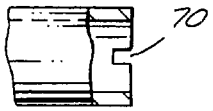
FIG. 4 is a fragmentary sectional view of one end of the camshaft taken along line 4–4 of FIG. 3.

Referring now in more detail to the drawings, a camshaft assembly 10 is shown in FIG. 1 and has a shaft 12 with a plurality of cam lobe elements 14 and bearing journal elements 16 affixed thereon. A radial thrust bearing element 18 is affixed to one end 22 of the shaft 12. A cam timing gear or sprocket 20 is attached to the one end 22 of the shaft for operably connecting the camshaft assembly 10 to the timing apparatus of an engine (not shown).

Shaft 12 is an essentially cylindrical elongate hollow tube preferably formed of an ordinary low carbon steel, cold extruded to a desired inside and outside diameter and cut to a desired length. Each cam lobe element 14 is a non-cylindrical disc having an opening 30 for receiving the shaft 12 therethrough. Each bearing journal element 16 is an essentially cylindrical disc having an axial opening 32 for receiving the shaft 12 therethrough. The radial thrust bearing 18 is an essentially cylindrical disc having an axial opening 38 for receiving the shaft 12 therethrough and a shoulder or flange 34 extending radially outward from one end of the bearing providing a first thrust bearing surface 36 of the camshaft assembly 10.

The openings 30, 32 and 38 are of a diameter slightly larger than the outside diameter of the shaft 12. The shape of the openings may be of a circular shape but are preferably of a slightly non-circular shape such as a hexagon as described in U.S. Pat. No. 4,597,365 or a non-circular rounded polygon as described in U.S. Pat. No. 4,841,627, both of which are incorporated in their entirety herein by reference. The noncircular shape of the openings 30, 32 and 38 provides better torsional retention of the elements 14, 16 and 18 on the shaft 12. The assembly process is briefly described herein.

Each of the elements 14, 16 and 18 and any other desired elements are preferably placed in a fixture such that the openings 30, 32 and 38 are axially aligned. The elements are securely held in the fixture in a longitudinally predetermined spaced apart relationship to one another. Additionally, the cam lobes 16 are rotationally or angularly oriented relative to one another as secured in the fixture. The shaft 12 is then slid through the aligned openings of the elements to a predetermined longitudinal position. Alternatively, the elements may be placed on the shaft and then the entire assembly may be placed in a fixture to align and position the elements in the desired manner.

Each of the elements 14, 16, 18 and other desired elements are affixed to the shaft 12 by mechanically expanding the shaft into an interference relationship with the openings 30, 32 and 38 of each element. Preferably, to achieve the desired mechanically expanded condition, the shaft is expanded or ballized by forcing a ball having a diameter slightly larger than the inside diameter of the shaft through the shaft.

Once the cam lobes 14 and bearing journals 16 and 18 are affixed to the shaft 12, the assembly is removed from the fixture and the wearing surfaces of the lobes and journals are ground to the desired surface finish and final dimensions. The thrust end 22 of the camshaft 10 in this form can be finished by grinding the sprocket mounting diameter of the shaft and the radial thrust bearing to final dimensions and desired surface finish using a centerless grinding process. Prior hollow camshaft designs do not permit use of the less expensive and faster centerless grinding process because the thrust bearing could not be split as in the present invention.

Preferably, the bearing journal elements 16 and 18 are formed of medium carbon steel and heat treated to a minimum Rockewell surface hardness of HR "C" 28—36. Alternatively, the elements 16 and 18 may be molded of cast iron or powdered metal and then surface heat treated to provide the desired surface hardness. The cam lobe elements 14 are also preferably made of alloy steel but may also be of cast iron or powdered metal. The bearing surfaces of the cam lobes however are preferably induction hardened to a minimum Rockwell surface hardness of HR "C" 57.

Attached to the one end 22 of the shaft 12 is the camshaft timing sprocket 20 for operably connecting the camshaft assembly 10 to a timing mechanism (not shown) of an engine. Preferably, the sprocket 20 has a central cylindrical hub 40 having an integral larger diameter gear 42 in the form of a circular disc extending radially outward from the hub. The sprocket 20 is preferably molded from a powdered metal such as 5150 or 5200 steel sintered powdered metal. For engaging the engine timing mechanism, the outer circumferential surface 44 of the gear 42 has a plurality of gear teeth 46 molded integrally with the sprocket.

The hub 40 is disposed coaxially with the axis of the gear 42 and has a bore 48 passing axially through the hub 40. A larger diameter counterbore 50 for receiving therein the one end 22 of the shaft 12 is formed in hub 40 coaxial with the gear teeth 46 of the sprocket and hence coaxial with the bore 48. A shoulder 52 formed at the juncture between the bore 48 and counterbore 50 provides a positive stop for the shaft 12 to longitudinally position the sprocket on the one end 22 of the shaft 12. The inner hub radial surface 54 is machined to a desired surface finish and precise distance from shoulder 52 for providing the second thrust bearing surface 54.

A protrusion or key 60 is preferably formed within the counterbore 50 integral with the hub 40 and extends radially inward from the counterbore 50 and axially from the shoulder 52 into the counterbore 50. The top surface 62 of the key 60 is preferably flush with the inside surface 64 of the bore 48 within the hub 40. The length and cross-sectional width of the key 60 are substantial enough such that the key withstands the loads placed upon it during installation and use of the sprocket 20.

A notch 70 is preferably disposed in the one end 22 of the shaft 12 having a width and length corresponding to the width and length, respectively, of the key 60 for receiving the key when the sprocket 20 is slid over the one end of the shaft. The key aligns with and slips into the notch allowing the sprocket to slip over the one end of the shaft until the shaft abuts the shoulder 52 within the counterbore 50. The notch and key provide accurate rotational or angular alignment between the teeth 46 of the sprocket 20 and the cam lobes 14 on the shaft 12 thereby providing accurate timing between the cam elements 14 and the gear teeth 46 on the sprocket.

Alternatively, the key may be formed in the one end of the shaft and the notch formed in the hub. Another alternative would be to provide corresponding notches in both the shaft and the hub for receiving a separate key in the space formed therein. This alternative is typically described as a key and way orientation method.

To retain the sprocket 20 on the one end 22 of the shaft 12, a fastener or bolt 80 with a shank 82 having threads 83 formed thereon is inserted through the bore 48 of the sprocket into the internal diameter of the one end of the shaft. Within the one end 22 of the shaft 12, complimentary threads 84 are preferably roll formed or cut on the inside shaft surface 86 for engaging the bolt threads 83. The bolt 80 also has a head 88 with an integral washer 90 extending radially outward from the head 88 adjacent the shank 82 of the bolt. The head 88 is preferably of a hex configuration to be securely engaged by a complimentary hex tool or socket for rotating and hence threading the bolt into the one end of the shaft. The washer provides sufficient surface contact against the outer hub radial surface 92 of the sprocket 20 to retain the sprocket on the shaft and align and retain it perpendicular to the axis of the shaft when the bolt is tightened to a predetermined desired torque.

What is claimed is:

1. A camshaft assembly for an engine comprising, a hollow tubular elongate shaft, a plurality of cam lobe and bearing journal elements each having an axial opening therethrough sized for being received and positioned along said shaft prior to mechanical expansion thereof, said elements being oriented and positioned along said shaft in a predetermined spaced apart relationship, said cam elements each being further rotationally oriented in a predetermined angular alignment relative to one another, at least one radial thrust bearing element having an axial open therethrough also sized for being received on said shaft prior to mechanical expansion there and being located nearest one end of said shaft and further having an annular radially protruding thrust bearing surface, said elements being secured to said shaft by mechanical expansion of said shaft into an interface relationship with said openings in said elements, internal threads formed within and adjacent said one end of said shaft, a cam timing gear or sprocket having an axial through-bore means sized to telescopically fit onto the outside surface of said shaft after said mechanical expansion thereof, said gear or sprocket having an annular radial thrust bearing surface juxtaposed to said thrust bearing surface of said radial thrust bearing element, an externally threaded fastener means passing through said through-bore means and securing said cam timing gear or sprocket to said one end of said shaft by said fastener means engaging said cam timing gear or sprocket and by external threads of said fastener means mechanically engaging said shaft internal threads with said cam timing gear or sprocket axial through-bore means telescopically assembled onto said shaft one end, and cooperative interengaging recess and projection means disposed on said one end of said shaft and on said cam timing gear or sprocket operable to accurately align said cam timing gear or sprocket in a predetermined rotational angular orientation with said cam lobe elements on said shaft.

2. The camshaft assembly according to claim 1 wherein said cam timing gear or sprocket through-bore means further comprises an axial bore opening away from said shaft one end and a counterbore sized to fit on said shaft after said mechanical expansion and being coaxial with and a larger diameter than said bore to define a shoulder junction therebetween in said cam timing gear or sprocket for receiving said one end of said shaft to abut said shoulder to axially position said cam timing gear or sprocket on said shaft.

3. The camshaft assembly according to claim 2 wherein said projection is a key formed integral with said cam sprocket and extending radially inward from said counterbore and wherein said recess in a notch formed in said one end of said shaft for receiving said key therein.

4. The camshaft assembly according to claim 1 wherein said cam sprocket is molded from a powdered metal.

5. The camshaft assembly according to claim 4 wherein said powdered metal is sintered steel.

6. The camshaft assembly according to claim 1 wherein said shaft is formed of steel.

7. The camshaft assembly according to claim 6 wherein said steel is an ordinary low-carbon steel.

* * * * *

UNITED STATES PATENT AND TRADEMARK OFFICE

CERTIFICATE OF CORRECTION

PATENT NO. : 5,826,461
DATED : October 27, 1998
INVENTOR(S) : Roy G. Kaywood and John M. Yost It is certified that error appears in the above-identified patent and that said Letters Patent is hereby corrected as shown below:

Col 5, Line 10, change "in" (first occurrence" to "is".

Signed and Sealed this

Twenty-third Day of March, 1999

*Attest:*

Q. TODD DICKINSON

*Attesting Officer*

*Acting Commissioner of Patents and Trademarks*